United States Patent [19]

Boyle

[11] 4,037,778

[45] July 26, 1977

[54] UNIVERSAL BAG SUPPORT

[76] Inventor: Kenneth E. Boyle, 9126 Hayes, Overland Park, Kans. 66212

[21] Appl. No.: 720,579

[22] Filed: Sept. 7, 1976

Related U.S. Application Data

[63] Continuation of Ser. No. 553,250, Feb. 26, 1975, abandoned.

[51] Int. Cl.[2] ..... B65D 33/02; B65B 67/12

[52] U.S. Cl. ..... 229/55; 53/390; 141/390; 248/99

[58] Field of Search ..... 53/27, 29, 35, 36, 187, 53/191, 192, 193, 257, 260, 261, 262, 390; 220/65; 141/390, 316, 114; 93/36.01; 248/95, 99, 100, 101; 229/14 BE, 14 B, 55

[56] References Cited

U.S. PATENT DOCUMENTS

| | | | |
|---|---|---|---|
| 176,555 | 4/1876 | Scholfield | 248/99 |
| 1,653,393 | 12/1927 | Cox | 141/390 |
| 1,879,410 | 9/1932 | Morris et al. | 93/36.01 X |
| 2,430,155 | 11/1947 | Buttery | 248/95 X |
| 2,502,586 | 4/1950 | Ottinger | 53/27 |
| 2,731,184 | 1/1956 | Thurber, Jr. | 141/390 X |
| 3,779,496 | 12/1973 | Welles | 248/99 |
| 3,915,329 | 10/1975 | Zaks | 220/65 |

*Primary Examiner*—Othell M. Simpson
*Assistant Examiner*—Horace M. Culver
*Attorney, Agent, or Firm*—Schmidt, Johnson, Hovey & Williams

[57] ABSTRACT

An internal support for holding limp plastic refuse bags in an upright, free-standing, open condition is in the nature of a smooth liner sheet having interconnected panels that are freely swingable, without substantial inward or outward bias, toward and away from one another. The panels are initially held in a partially overlapped condition during insertion of the liner into a bag, whereupon they are swung outwardly away from one another to the extent permitted by the dimensions of the bag selected for use, the panels in such expanded condition frictionally engaging the bag sidewall to hold the latter against collapse. So expanded, the liner completely or at least substantially covers the entire surface of the bag sidewall so that the latter is protected from engagement with refuse entering the bag during loading, hence precluding accidental pulling of the bag from the liner. The liner is readily slipped from between the refuse and the bag after the latter is loaded so that the liner can then be reused with a bag of the same or different dimensions.

1 Claim, 5 Drawing Figures

UNIVERSAL BAG SUPPORT

This is a continuation, of application Ser. No. 553,250 filed on 2/26/75, and now abandoned.

This invention concerns refuse packaging devices of the type commonly used to store and transport household garbage and yard debris. More specifically this invention pertains to method and apparatus for use in holding limp plastic bags in a free-standing, opened condition during loading of such bags with yard debris or other refuse.

RELATED PRIOR ART

| Pat. No. | Patentee |
|---|---|
| 2,731,184 | A. E. Thurber, Jr. |
| 2,111,327 | W. M. O'Hare |
| 2,636,656 | S. Tanabe |
| 1,211,278 | J. O. Blum |
| 576,782 | E. R. Goodrich |
| 3,722,561 | T. W. O'Leary et al. |
| 169,276 (Sweden) | N. H. Boll |

Plastic bags are commonly used for convenient packaging of refuse or debris. These bags often are used in conjunction with yard work where debris such as sticks, leaves, prunings and grass clippings are placed in a bag for removal from the area. These bags also are used to package debris and trash from outside area cleanups or policings. A major problem with loading of such bags is that they are not free-standing or capable of self-support, and this flaccidness or limpness makes loading extremely difficult, particularly at the onset of loading a new bag. The non-supportive nature of these bags not only makes them difficult to load, but also frequently results in spillage of collected trash when a partially filled bag falls over. It can be appreciated therefore that much time and effort are wasted when a worker has to support a trash bag with one hand while loading it with the other; certainly, it would be much more advantageous to free both hands of the worker for loading of the bag.

Another problem in the use of plastic bags results from the relatively weak nature of the bag sidewalls. Primarily for cost reasons, most bags intended for household or yard use are made from light to medium weight plastic film. The bag walls, while normally of adequate strength to package trash and debris, are oftentimes not strong enough to withstand localized stresses encountered during loading. Thorns, rosebushes, evergreen clippings and other types of yard debris tend to rip and tear the bag sidewall as they are loaded into the bag and slid along the sidewall from the bag opening to a resting place within the bag. Additionally, the bag walls are subject to puncture from rigid yard debris such as sticks, bark, or heavy weeds, etc. Localized tearing or puncture of the bag walls, of course, reduces the overall strength of the bag wall and limits its ablility to function as a trash package. The tendency is for the small tears or punctures to propagate until the sidewall of the bag contains a large gaping hole which becomes an exit for packaged trash. This condition is highly undesirable and decreases the practicality of using plastic bags as refuse packages, particularly when packaging yard debris.

The relatively weak sidewalls of plastic bags presents another problem in the use of these bags for trash packaging. Due to the bulky condition of most household trash and yard debris, these materials are generally compacted after they are loaded into trash containers.

The compacting process can produce localized stresses in the container sidewall causing a weak sidewall to rupture or stretch in the area of high stress concentration. Obviously, it is undesirable to have a trash container with a ruptured sidewall. Likewise, a stretched sidewall presents a low strength area which is susceptible to subsequent rupturing during transport of the trash package and is therefore also highly undesirable.

Many different types of bag holders have, of course, been developed previously, and for purposes of the present description, these may be broadly divided into two classes, i.e., those that support the bag from the outside and those that support the bag from the inside such as the support of the present invention. Where bags have been supported on the outside, the most common arrangement has been to actually suspend the open bag from the support, rather than render the bag capable of standing on the ground or other surface in an upright condition. In such instances it is of course necessary to have some type of gripping or clamping mechanism adjacent the mouth of the bag which tightly engages the sidewall of the bag and holds it with sufficient tenacity to prevent the bag from slipping free of the support as materials are dumped aggressively into the opened bag. These external supports have suffered from a number of disadvantages, not the least of which is costly construction.

A similar arrangement is utilized in many supports which are designed to be inserted into the inside of the bag and to support the same from within, insofar as gripping or clamping the mouth of the bag in an opened condition is concerned. Several examples of this type of internal, gripped support are illustrated in the above-listed patents. However, such previous internal supports have the same drawback as previous external supports in that by requiring clamping or gripping mechanism, the complexity and cost of the supports is inherently increased, in some situations to such an extent that the price of the support becomes more than the market will bear.

Other internal supports such as, for example, illustrated in the above-listed Swedish Pat. No. 169,276 issued to N. H. Boll have eliminated costly clamping and gripping mechanisms in favor of an open wire frame assembly having hingedly interconnected frame sections that are spring-loaded so that the sections automatically swing outwardly away from one another after the frame has been inserted into the bag, thereby forcing the bag to be held in an opened condition as a result of the spring force exerted by the frame sections. While such an arrangement avoids the expense involved in clamping mechanisms, that expense is more than made up for by the spring-loading and open wire frame construction of the support, thereby in reality simply shifting the cost concentration from one point to another without decreasing the total amount.

In light of the foregoing, it is apparent that there has heretofore been an unfilled need in this art for a non-complex relatively inexpensive and yet highly practical support for flexible bags which will hold the same in an opened condition for accepting trash and debris. It has now been discovered that this need can be fully and effectively met by providing an internal support in the nature of a liner sheet with planer, smooth surface panels that are hinged freely to one another without requiring spring loading. It has been found that whereas spring pressure was previously required in the open wire frame construction of previous devices, the broad expanse of surface area available on the planer panels of the present internal support provides sufficient frictional contact with the sidewall of the flexible bag that the latter can be fully supported against collapse without the need for any spring biasing mechanism. While large exposed areas of the bag in the previous open frame supports made the bag vulnerable to being pulled off the frame as sticks and other trash would engage the sidewall of the bag during entry, the smooth planer surfaces on the panels of the present support assure that all or at least a sufficiently large amount of the sidewall is guarded against contact with the entering debris. Thus, there is very little if any tendency for the bag to be pulled off the panels as the debris is being inserted, and the frictional contact between the outer face of the panels and the bag sidewall is fully sufficient to retain the bag in an upstanding, opened condition, even though the panels are simply standing on the ground or other surface in a spread-apart position determined by the user without outward bias.

In accordance with the foregoing, it is therefore one important object of the present invention to provide an internal support for flexible trash bags otherwise incapable of holding themselves in an upstanding, opened condition which is of low cost, non-complex construction and yet offers an excellent solution to the problems presented by previous internal supports such as bag tearing or puncturing and accidental removal from the support during loading.

Another important object of the present invention is to provide an internal bag support which can quite easily be slipped from within the bag after the latter has been filled, even if the contents include sticks, thorns and the like which might become entangled with other supports of open wire frame construction.

A further important object of this invention is to provide an internal support which is universally adjustable to accommodate bags of many different sizes without detracting from the ability of the support to securely hold such bags against collapse.

A more specific important object of the present invention, in accordance with the foregoing objects, is to provide an internal bag support in the nature of a liner sheet having smooth, planer panels which are hingedly interconnected without substantial outward spring bias so that the broad, flat surfaces of the panels can frictionally engage the bag sidewall to hold the latter expanded and, at the same time, such panels can cover the sidewall to guard the latter against tears, punctures, and pulling from sticks, thorns and other articles that may be inserted into the bag. In the drawings.

Figure 1:
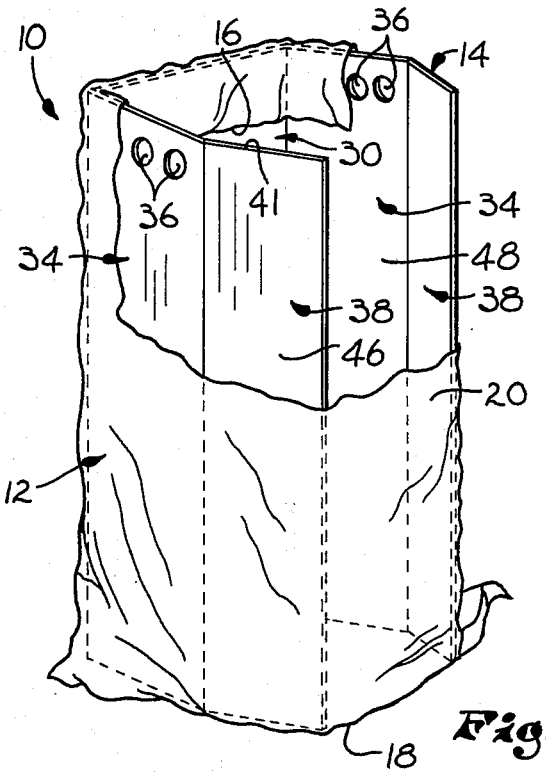
FIG. 1 is a perspective view showing the supporting bag of the present invention with the liner in the expanded position and with a portion of the bag broken away to reveal the liner.

Turning now to the drawings, FIG. 1 shows a refuse packaging assembly, broadly designated by the numeral 10, comprising a large flexible bag 12 and a self-supporting liner 14 disposed within bag 12 in cooperating engagement therewith. Large bag 12 has an annular open top 16, closed bottom 18, and a flaccid sidewall 20 extending therebetween that is too weak to hold bag 12 against collapse.

Figure 2:
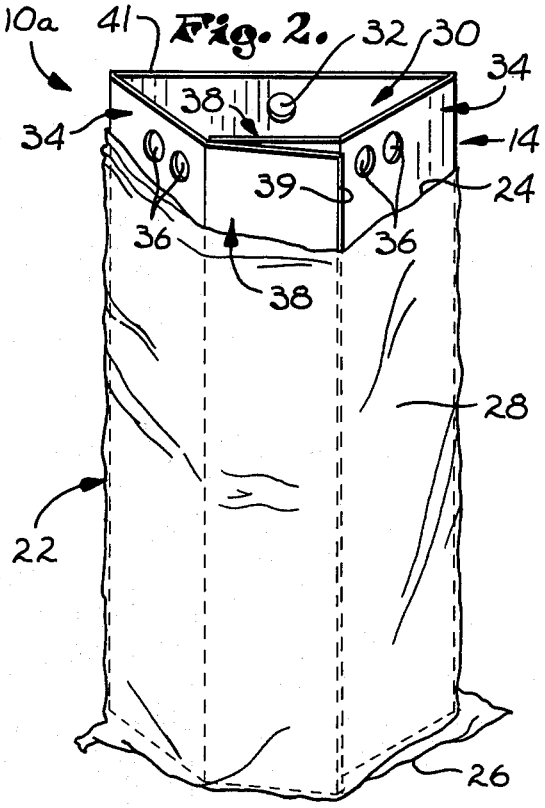
FIG. 2 is a perspective view showing the expanded liner supporting a smaller bag.

FIG. 2 shows a refuse packaging assembly broadly depicted by numberal 10*a*, comprising smaller flexible bag 22 and the same self-supporting liner 14, disposed therein. Small bag 22 has an annular open top 24, closed bottom 26, and a flaccid sidewall 28 extending therebetween that is too weak to hold bag 22 against collapse.

Figure 3:
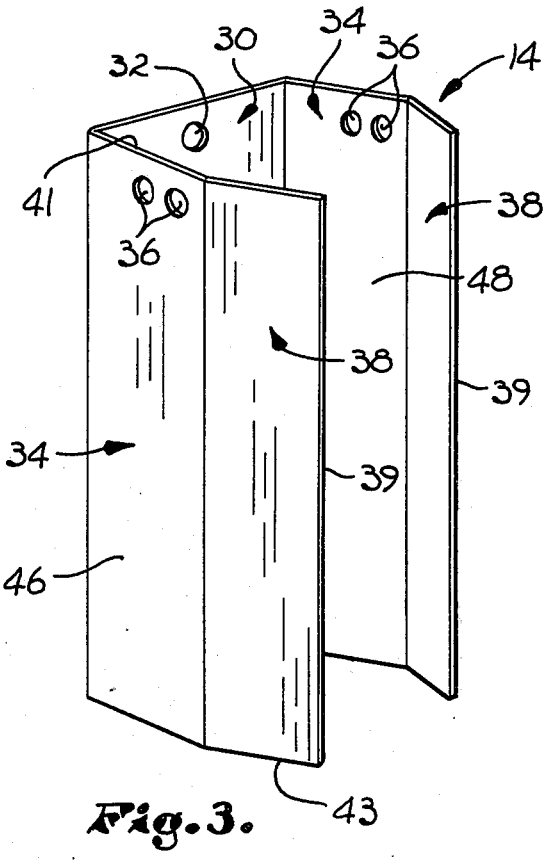
FIG. 3 is a perspective view of the liner in an expanded position standing alone.

FIG. 3 shows the construction details of liner 14. Central panel 30 is an elongate rectangular sheet having a finger hole 32 through the panel near the top end thereof, and a pair of side panels 34 are pivotally interconnected to opposite sides of panel 30. Each side panel 34 is an elongate rectangular sheet having a pair of lift holes 36 disposed perpendicularly therethrough near its normally top edge. One side of each panel 34 is joined to panel 30 and the opposite side of each panel 34 is joined to a floating panel 38. Floating panels 38 also are a pair of elongate rectangular sheets, each having one side edge connected to a panel 38 and being provided with a free side edge 39.

Figure 4:
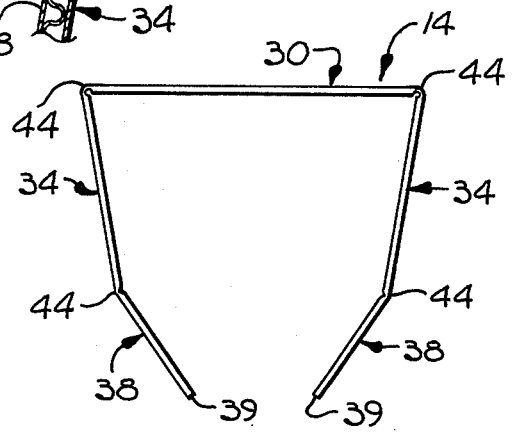
FIG. 4 is a top plan view of the liner as shown in FIG. 3.

Panels 30, 34 and 38 are substantially the same length but vary in width as shown in FIG. 4. Panels 34 are somewhat narrower than central panel 30, while panels 38 are even narrower than panels 34. Panels 30, 34 and 38 are interconnected such as to define a continuous top edge 41 and a continuous bottom edge 43.

Figure 5:
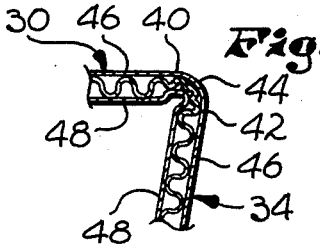
FIG. 5 is an enlarged, fragmentary detail view of one typical corner of the liner.

An interconnection between central panel 30 and one of the side panels 34 is shown in detail in FIG. 5 where a left elongate edge 40 of panel 30 i hingedly interconnected to a right elongate edge 42 of panel 34 by a thin, flexible web 44. Web 44 extends the entire elongate length of panels 30 and 34 and is substantially free of resiliency or "memory" such that panels 30 and 34 are almost completely free-swinging with respect to one another, practically devoid of any spring-loading. Such web 44 may be conveniently produced through a simple creasing operation when the liner 14 is constructed, for example, of cardboard material. In other instances the panels 30 and 34 may be spaced slightly from one another along edges 40 and 42 and other hinge structure utilized in lieu of web 44. This, however, has the disadvantage of increased cost. The arrangement in FIG. 5 is typical of the three other hinge joints in the liner 14 between panels 30, 34 and 38.

Each of the panels 30, 34 and 38 has an outside planer surface 46 and an opposed inside planer surface 48. Of course, the webs 44 are adapted to allow swinging of the panels 30, 34 and 38 toward, as well as away from, one another.

Use of the liner 14 can be quite simply described, and such will be done with the large bag 12 first. Normally, the liner 14 and bag 12 are stored separately until used. Bag 12 is folded and boxed with a plurality of similar bags; liner 14 is conveniently stored in a flat position with panel 30. So folded, liner 14 occupies very little space and can be readily stored in areas where space is at a premium. When it is desired to use the packaging assembly 10, bag 12 is unfolded and held in an open, upright position over a supporting surface. Liner 14 may then be partially unfolded and held with the panels 38 overlapped so as to define a generally cylindrical structure which is smaller in diameter than annular top 16. In this position, liner 14 is uprightedly inserted into bag 12 through top 16 until bottom edge 43 encounters bottom 18, whereupon panels 34 and 38 are swung outwardly away from one another to expand liner 14 to the extent permitted by bag 12.

Alternatively, liner 14 may remain completely folded in a flat condition and be inserted into bag 12 while arranged in that manner, this in many instances being preferred approach because of the small dimensions presented by the liner 14 when so folded. Further, arrangement of finger holes 32 and 36 is such that hole 32 aligns with one hole 36 in each panel 34 when liner 14 is folded flat, enabling the user to readily insert his finger or thumb through the aligned holes 32 and 36 to easily retain control of the liner 14 as it is introduced into bag 12. In the expanded position of liner 14, the entire expanse of its surfaces 46 frictionally engages sidewall 20 of bag 12 and thereby securely holds the latter in an open condition, even though panels 34 and 38 are under no outward spring loading. Portions of sidewall 20 which extend above edge 41 may be folded down over the latter to rest on surfaces 48.

Once liner 14 is in the expanded position, refuse packaging assembly 10 presents an upright, freestanding open container which is ready for loading of trash or yard debris. Refuse material may then be loaded and compacted in assembly 10 until the interior thereof is filled, whereupon liner 14 is separated from bag 12. Separation of liner 14 is accomplished by manually engaging lift holes 36 or finger hole 32 and raising liner 14 vertically upwardly through opening 16. During removal of liner 14, panels 30, 34 and 38 are slipped upwardly from between the interior of sidewall 20 and the refuse material which has been loaded into the bag; surfaces 48 slide along the loaded material. Once liner 14 has been removed, bag 12 is disposed of in the normal manner and liner 14 is available for reuse with another bag such as, for example, the small bag shown in FIG. 2.

The use of liner 14 with small bag 22 is practically identical to its use with the larger bag 12 in that precisely the same manner of insertion, support and withdrawal is involved. The difference lies in the extent to which the liner 14 is expanded within bag 22 as compared to bag 12. In the latter, liner 14 may be expanded so much that a gap is presented between the edges 39 of the two front panels 38, and the bag 12 may be so tall that the upper margin thereof may be folded over the upper edge 41 of liner 14. When within small bag 22, however, the front panels 38 of liner 14 remain overlapped because the diameter of bag 22 is not sufficiently large to permit separation of panels 38 to the extent permitted with bag 12. Further, the short height of bag 22 causes the upper edge thereof to be disposed slightly below the corresponding upper edge of liner 41. It is to be emphasized, however, that in both situations, the panels 30, 34 and 38 frictionally engage the sidewalls 20, 28 of bags 12, 22 respectively and thereby hold such bags against collapse. Frictional contact alone provides the necessary retaining force, without the assistance of outward spring biasing of the panels, and the protective covering of sidewalls 20, 28 presented by liner 14 eliminates or substantially minimizes the possiblity that such sidewalls will be pulled from the liner during loading, as has heretofore been a constant source of aggravation with previous open frame, internal supports.

It is to be understood, however, that while the liner 14 has been illustrated in connection with only two different bags 12 and 22, such is done by way of example only because, in fact, liner 14 is virtually universal. By virtue of its ready expandability during setup, liner 14 may be used with a vast assortment of bag sizes without detracting from its ability to fully and effectively maintain such bags in a properly opened, upstanding condition. It matters not whether the particular bag chosen for use is taller or shorter than liner 14 since, as clearly illustrated in FIGS. 1 and 2, either condition is fully accommodated by virtue of the fact that the holding action is not centered along the top of the bag, but rather along the entire sidewall of the bag through the outer surfaces 46 of panels 30, 34 and 38. And bag width is of no concern since in all cases the panels 30, 34 and 38 are simply swung outwardly to the extent permitted by the size of the bag. In some instances front panels 38 may be overlapped, while in others they might be spaced slightly apart. The retaining and holding action of the liner 14 is equally effective in all cases, regardless of bag size.

It will be apparent, then, that the present invention greatly reduces the problems heretofore encountered with the use of trash and yard debris bags. The freestanding nature of the bag 12 or 22 after liner 14 has been inserted eliminates the problem of holding and maintaining the bag in an erect position for loading trash material. An upright, open-ended, stable structure is presented which is self-supporting and well adapted for top loading of trash material.

Additionally, liner 14 protects against tear and puncture-inflicting material which would normally come in contact with sidewalls of a selected bag during loading of trash. In the present invention, the potential damage-inflicting material communicates with surfaces 48 during the loading operation. Due to the rigid nature of panels 30, 34 and 38, surfaces 48 can withstand localized stresses caused by the tear and puncture-inflicting material with little or no damage to these surfaces. Consequently, damage to the sidewall of the selected bag from loading of trash material is greatly reduced or eliminated. Moreover, the interior surfaces 48 of panels 30, 34 and 38 present a rigid forming chamber to allow extensive compaction of loaded trash material without incurring any structural damage. Trash material can be tightly compressed against surfaces 48 forming a dense, shaped mass of trash. This block of trash maintains its shape to a great degree after liner 14 has been removed so that very little of the original compacting stress is later imparted to the sidewall of the selected bag. The latter thus effectively serves as an outer wrapper to encase the block of trash which has been formed within liner 14.

The solid nature of panels 30, 34 and 38 also is of great benefit in stabilizing the packaging assembly 10 during loading, because once the first mass of refuse has been deposited into liner 14, the panels 30, 34 and 38 are pressed outwardly even more tightly than before against the bag sidewall 20. Further, panels 30, 34 and 38 enable liner 14 to be used somewhat in the nature of a slip form if a large bag such as bag 12 in FIG. 1 is used. In this respect instead of folding top 16 of bag 12 over liner edge 41 as illustrated in FIG. 1, top 16 may be left generally upright so that as refuse is deposited into assembly 10, liner 14 may be periodically pulled further upwardly toward top 16 and set at a new height for the next deposit of refuse. In this manner even though the selected bag might be considerably taller than liner 14 the bag can still be filled substantially to its top, thereby avoiding costly and inefficient wastage of available bag space.

Having thus described the invention, what is claimed as new and desired to be secured by Letters Patent is:

1. A free-standing refuse receptacle comprising:

a normally upright, flexible bag having a closed bottom adapted for resting on a supporting surface, an open top, and a continuous, annular sidewall extending between said top and bottom to define an interior refuse-receiving space, said sidewall being flaccid throughout its expanse so as to render the bag incapable of supporting itself on said surface in an open and upright condition; and an erect, substantially tubular and horizontally polygonal device within said bag holding the latter in said normally open and upright condition, said device comprising a sheet of material having a pair of opposite, normally vertical end edges, a pair of opposite, normally horizontal upper and lower edges extending continuously between said end edges, and a pair of oppositely facing, normally inner and outer surfaces bounded by said edges, said sheet being received within said space with said lower edge engaging the bottom of the bag and being substantially devoid of inherent resiliency but sufficiently rigid to avoid buckling, said sheet having four vertically extending hinge lines formed therein, each extending continuously from the upper edge of the sheet to the lower edge thereof, a central paid of said hinge lines defining a central upright panel of said sheet therebetween that has a width defined by the distance separating said central pair of lines, an outer pair of said hinge lines being located on opposite sides of said central pair so that a pair of outer upright panels are presented on each side of said central panel, one panel of each outer pair having its width defined by the distance separating the two hinge lines between which the panel is disposed, and the other panel of each outer pair having its width defined by the distance separating a corresponding said outer edge of the sheet and the next adjacent hinge line, the combined widths of each pair of outer panels being substantially the same as said width of the central panel, said outer surface of the sheet frictionally supporting the sidewall of the bag and said end edges of the sheet being mutually detached, all of said hinge lines being operable to permit their respective panels to swing inwardly in such a direction as to move the portion of the sheet's inner surface presented by the moving panel toward that of the enext adjacent panel, said hinge lines being further operable to permit the panels to be swung inwardly to such an extent as to render the device folded into a compact condition in which the two pairs of outer panels are alternately superimposed on said central panel and in which the final dimensions of the compacted device are substantially defined by said width of the central panel and the distance between said upper and lower edges of the sheet.

* * * * *